US012037808B2

(12) United States Patent
Sun et al.

(10) Patent No.: US 12,037,808 B2
(45) Date of Patent: Jul. 16, 2024

(54) FOLDING CANOPY WITH EAVE STRUCTURE

(71) Applicant: ZHEJIANG JIANSHENG LEISURE PRODUCTS CO., LTD, Zhejiang (CN)

(72) Inventors: Yuanru Sun, Zhejiang (CN); Chao Zeng, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 417 days.

(21) Appl. No.: 17/503,397

(22) Filed: Oct. 18, 2021

(65) Prior Publication Data

US 2022/0034118 A1 Feb. 3, 2022

Related U.S. Application Data

(63) Continuation-in-part of application No. 16/281,022, filed on Feb. 20, 2019, now Pat. No. 11,306,511.

(30) Foreign Application Priority Data

May 29, 2018 (CN) ..... 201810530419.6
May 29, 2018 (CN) ..... 201820809963.X

(51) Int. Cl.
*E04H 15/50* (2006.01)
*E04H 15/58* (2006.01)
*E04H 15/52* (2006.01)

(52) U.S. Cl.
CPC ..... *E04H 15/50* (2013.01); *E04H 15/58* (2013.01); *E04H 15/52* (2013.01)

(58) Field of Classification Search
CPC ..... E04H 15/50; E04H 15/58; E04H 15/52
USPC ..... 135/117, 131, 135, 145, 146, 159
See application file for complete search history.

(56) References Cited

U.S. PATENT DOCUMENTS 5,035,253 A * 7/1991 Bortles ..... E04H 15/50 135/117
6,848,461 B2 * 2/2005 Tsai ..... E04H 15/50 135/153
7,367,348 B2 * 5/2008 Tsai ..... E04H 15/50 135/147

(Continued)

FOREIGN PATENT DOCUMENTS

CN 109505454 3/2019
CN 109505454 A * 3/2019 ..... E04H 15/32

(Continued)

*Primary Examiner* — Robert Canfield
(74) *Attorney, Agent, or Firm* — JCIP GLOBAL INC.

(57) ABSTRACT

A folding canopy with an eave structure includes a plurality of support legs and a canopy top folding assembly. The canopy top folding assembly includes a hingedly connected folding top strut and a hingedly connected folding slant strut. Each of the support legs is disposed with a top seat and a sliding seat disposed one above the other. An eave mechanism is disposed between the folding slant strut and the top seat, and the eave mechanism includes a diagonal strut and an eave strut. One end of the diagonal strut is hingedly connected to the folding slant strut, and the other end of the diagonal strut is hingedly connected the eave strut, and an inner end of the eave strut is hingedly connected to the top seat.

18 Claims, 9 Drawing Sheets

(56) References Cited

U.S. PATENT DOCUMENTS 8,544,489 B2 * 10/2013 Choi ..... E04H 15/50 135/147
8,616,226 B2 * 12/2013 Ma ..... E04H 15/42 135/117
8,701,692 B2 * 4/2014 Holland ..... E04H 15/50 135/145
9,739,073 B2 * 8/2017 Huang ..... E04H 15/50
10,119,297 B2 * 11/2018 Choi ..... E04H 15/50
10,280,645 B1 * 5/2019 Yang ..... E04H 15/50
10,590,676 B2 * 3/2020 Ma ..... E04H 15/38
10,745,934 B2 * 8/2020 Choi ..... E04H 15/48
10,982,466 B2 * 4/2021 Huang ..... E04H 15/50
11,072,943 B2 * 7/2021 Sun ..... E04H 15/32
11,306,511 B2 * 4/2022 Sun ..... E04H 15/50
2007/0051397 A1 * 3/2007 Choi ..... E04H 15/50 135/117
2007/0186967 A1 * 8/2007 Zingerle ..... E04H 15/50 135/145
2011/0073148 A1 * 3/2011 Choi ..... E04H 15/50 135/144
2011/0308559 A1 * 12/2011 Ma ..... E04H 15/38 135/122
2013/0284225 A1 * 10/2013 Holland ..... E04H 15/46 135/145
2014/0023429 A1 * 1/2014 Lee ..... E04H 15/50 403/161
2014/0174491 A1 * 6/2014 Yang ..... E04H 15/48 135/144
2015/0376913 A1 * 12/2015 Choi ..... E04H 15/50 135/147
2016/0108639 A1 * 4/2016 Huang ..... E04H 15/50 135/144
2018/0080242 A1 * 3/2018 Choi ..... E04H 15/58
2018/0106066 A1 * 4/2018 Choi ..... E04H 15/60
2018/0106068 A1 * 4/2018 Choi ..... E04H 15/46
2020/0157838 A1 * 5/2020 Yuan ..... E04H 15/50
2020/0407999 A1 * 12/2020 Huang ..... E04H 15/50
2021/0040766 A1 * 2/2021 Sun ..... E04H 15/32
2022/0034118 A1 * 2/2022 Sun ..... E04H 15/50
2022/0228397 A1 * 7/2022 Yang ..... E04H 15/50
2022/0412119 A1 * 12/2022 Tao ..... E04H 15/50
2023/0295931 A1 * 9/2023 Xu ..... E04H 15/28 135/20.1
2023/0295951 A1 * 9/2023 Choi ..... E04H 15/38 135/143
2023/0399869 A1 * 12/2023 Grace ..... E04H 15/50
2024/0026704 A1 * 1/2024 Lu ..... E04H 15/48

FOREIGN PATENT DOCUMENTS

CN 112922440 A * 6/2021 ..... E04H 15/16
CN 220247786 U * 12/2023
WO WO-2020133855 A1 * 7/2020 ..... E04H 15/32

* cited by examiner

FOLDING CANOPY WITH EAVE STRUCTURE

CROSS-REFERENCE TO RELATED APPLICATION

This application is a continuation-in-part application of and claims the priority benefit of U.S. application Ser. No. 16/281,022, filed on Feb. 20, 2019. The prior U.S. application Ser. No. 16/281,022 claims the priority benefit of China application serial no. 201810530419.6, filed on May 29, 2018, and Chinese application serial no. 201820809963.X, filed on May 29, 2018. The entirety of each of the above-mentioned patent applications is hereby incorporated by reference herein and made a part of this specification.

BACKGROUND

Technical Field

The present invention relates to the field of outdoor tent, in particular to a folding canopy with an eave structure.

Description of Related Art

Tents have various structural forms, and the tent used for outdoor shade is usually a folding tent. Traditional folding tent has a relatively small shade area, in order to increase the tent shade area when it is unfolded, eave tents with eave structure are presented, wherein the top corner of the tent is disposed with extended eave struts, thus the purpose of increasing the shade area can be achieve through the eave strut disposed on the edge. This is done mainly by pivoting or inserting eave struts on the top strut of the canopy support frame, the outer end of which is movably extended out of each column. However, among the current folding tents, the eave struts are set independently of the tent body support frame, and need to be operated in two steps when unfolding or folding the tents. That is, when unfolding the tent, we have to unfold the tent main support frame first, and then detach or pull out the eave struts one by one, which is not easy to realize the operation because the eave struts are in a relatively high position, and when folding the tent the operation is in an opposite direction and the problem is the same. Therefore, problems such as having a complex structure, cumbersome and inconvenient folding and unfolding operation exist in present folding tents.

Patent publication of CN109505454A discloses a folding tent with an automatic eave structure, the eave assembly of the folding tent includes an connection sleeve set and an eave strut set, wherein the connection sleeve set includes a first second hinged seat, a second hinged seat and a third second hinged seat, and the eave strut set includes an eave strut, a diagonal strut and a push strut. The patent optimizes the push strut moving structure by optimizing the design, employing the structure design of center fixed combined with sliding at both ends, so that the push strut is able to complete a fine flat sliding and the length of the push strut is shortened to avoid the formation of interference; in addition, through the push strut combining with the first second hinged seat, the force bearing point of the eave strut is able to be in a movable state, which is convenient to realize the eave flipping of the eave strut; at the same time, the eave strut is limited by the first second hinged seat and the push strut, which increases the stability of the eaves. However, the eave strut set of the patent contains three strut parts: eave strut, diagonal strut and push strut. As the number of struts increases, the corresponding connection nodes will also increase, therefore the patent still has the problem that the eave structure is more complicated, and the complicated structure will in turn lead to more tedious assembly and production.

SUMMARY

In order to make up for the deficiencies of the prior art, the present invention provides a technical solution of folding canopy with an eave structure.

A folding canopy with an eave structure includes a plurality of support legs and a canopy top folding assembly cooperatively mounted on the plurality of support legs. The canopy top folding assembly includes a hingedly connected folding top strut and a hingedly connected folding slant strut. A top seat and a sliding seat being disposed at each of the support legs. One end of the folding top strut is hingedly connected to the top seat, one end of the folding slant strut is hingedly connected to the sliding seat, and an eave mechanism being coordinately arranged between the folding slant strut and the top seat. The eave mechanism includes a diagonal strut and an eave strut, one end of the diagonal strut is hingedly connected to the folding slant strut, and the other end of the diagonal strut is hingedly connected to the eave strut. One end of the eave strut is hingedly connected to the top seat. When the folding canopy develops from a folded state to an unfolded state, the sliding seat slides upward, the sliding seat drives the folding slant strut to move, the folding slant strut drives the diagonal strut to allow the eave strut complete a flip and the eave strut flips outward to an eave state.

Further, when the folding canopy is in the unfolded state, the eave strut extends out of the folding canopy, and the eave strut and/or diagonal strut abuts against the top seat.

Further, when the folding canopy is in the folded state, the folding canopy is retracted and closed, and the eave strut, the diagonal strut, the folding top strut and the folding slant strut are all folded into a state of being attached or being to be attached with the corresponding support leg.

Further, a first hinged seat is disposed on one of the diagonal strut and the folding slant strut, and the other one of the diagonal strut and the folding slant strut is hingedly connected to the first hinged seat.

Further, the first hinged seat employs a hinged connection bolt, such that the diagonal strut and the folding slant strut complete a hinged connection.

Further, a first hinged seat is disposed on the folding slant strut, and the first hinged seat includes a first hinged seat fixing part used for fixedly cooperating with the folding slant strut and a first hinged seat hinged connection used for being hingedly connected to the diagonal strut.

Further, a second hinged seat is disposed on one of the diagonal strut and the eave strut and the other is hingedly connected to the second hinged seat.

Further, the second hinged seat employs a hinged connection bolt, so that the diagonal strut and the eave strut complete a hinged connection.

Further, a cooperating part is disposed on the second hinged seat, and when the folding canopy is in the folded state, the cooperating part abuts against the diagonal strut or the eave strut.

Further, a shape of a coordinating surface of the cooperating part coincides with a shape of the diagonal strut or the eave strut.

Further, the second hinged seat is disposed on the eave strut.

Further, the eave strut has a mounting hinged connection at an inner end thereof, and the eave strut is hingedly connected to the top base through the mounting hinged connection.

Further, the mounting hinged connection is integrally or separately disposed at the eave strut.

Further, the mounting hinged connection employs a straight or curved strut construction.

Further, the mounting hinged connection is provided with a hinged connection hole, and the hinged connection hole is hingedly connected to the top seat through a hinged connection bolt.

Further, the top seat has a cooperating slot and when the eave strut is in the eave state, the eave strut and/or the diagonal strut is snapped to the cooperating slot.

Further, the canopy folding assembly further includes a central locking mechanism and a folding inner upper strut hingedly connected to the central locking mechanism. The folding inner upper strut is hingedly connected to the folding top strut, and one of the folding inner upper strut and the folding top strut is disposed with a snap, and when the folding canopy is in a fully unfolded state, the snap is snapped to the other one of the folding inner upper strut and the folding top strut.

Compared with the prior art, the present invention optimizes the design of the structure of a eave mechanism, so as to make the eave mechanism being able to achieve its function through the eave strut and the diagonal strut, eliminating the pushing strut and the corresponding node structure, thus making the folding canopy of the present invention simpler in structure, more convenient in assembly and production, and capable of saving costs.

DESCRIPTION OF THE EMBODIMENTS

Figure 1:
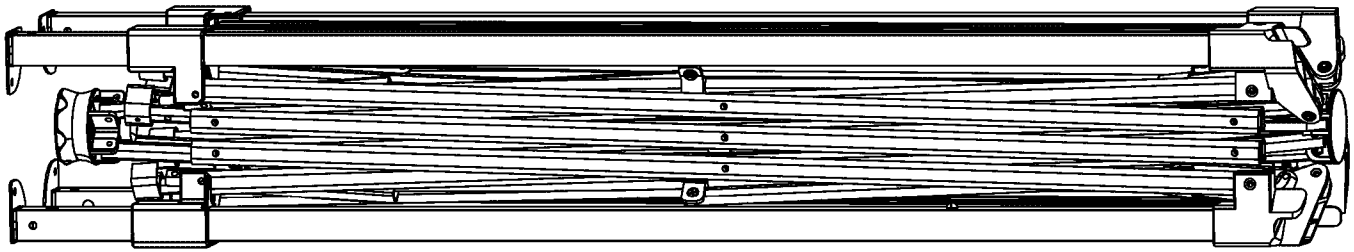
FIG. 1 is a structural view of the present invention showing a folding canopy in a folded state and being retracted and closed.

In the description of the present invention, it is necessary to be understood that the terms "one end", "other end", "outer side", "upper", "inner side", "horizontal", "coaxial", "central", "end", "length", "outer end", "inner end", etc. indicate an orientation or positional relationship based on the orientation or positional relationship shown in the accompanying drawings and are intended only to facilitate and simplify the description of the invention, not to indicate or imply that the device or element referred to must have a particular orientation, be constructed and operate in a particular orientation, and therefore are not to be construed as limiting the present invention. Wherein, the "inner end" refers to the end near the center of the folding canopy, and the "outer end" refers to the end away from the center of the folding canopy.

Please refer to FIG. 1-FIG. 9, a folding canopy with an eave structure includes a plurality of support legs 1 and a canopy top folding assembly cooperatively mounted on the plurality of support legs 1. The canopy top folding assembly includes a hingedly connected folding top strut 2 and a hingedly connected folding slant strut 3. Each of the support leg 1 is disposed with a top seat 4 and a sliding seat 5 disposed one above the other. An outer end of the folding top strut 2 is hingedly connected to the top seat 4, an outer end of the folding slant strut 3 is hingedly connected to the sliding seat 5, and an eave mechanism is coordinately arranged between the folding slant strut 3 and the top seat 4. The eave mechanism includes a diagonal strut 6 and an eave strut 7, one end of the diagonal strut 6 is hingedly connected to the folding slant strut 3, and the other end of the diagonal strut 6 is hingedly connected to the eave strut 7. An inner end of the eave strut 7 is hingedly connected to the top seat 4. When the folding canopy develops from a folded state to an unfolded state, the sliding seat 5 slides upward, the sliding seat 5 is capable of driving the folding slant strut 3 to move by sliding upward, the folding slant strut 3 drives the diagonal strut 6 to allow the eave strut 7 complete a flip and the eave strut 7 flips outward to an eave state.

In the above-mentioned structure, the eave mechanism is only able to achieve its function through the eave strut 7 and the diagonal strut 6. Compared with the prior art, the eave mechanism eliminates the pushing strut and the corresponding node structure, thus the folding canopy of the present invention is simpler in structure, more convenient in assembly and production, and is able to save costs.

Continuing to refer to FIG. 6-FIG. 9, the eave strut 7 has a mounting hinged connection 700 at its inner end, and the eave strut 7 is hingedly connected to the top base 4 through the mounting hinged connection 700. The mounting hinged connection 700 is disposed to enable the eave strut 7 to be flipped more easily.

Wherein, the mounting hinged connection 700 is provided with a hinged connection hole, and the hinged connection hole is hingedly connected to the top seat 4 through a hinged connection bolt.

In one of the preferred embodiments, the mounting hinged connection 700 of the eave strut 7 is disposed in an integral structure, and the mounting hinged connection 700 of the eave strut 7 is preferably in an arc structure, in addition, the mounting hinged connection 700 may also be in a straight strut structure, etc.

In one of the preferred embodiments, the mounting hinged connection 700 of the eave strut 7 is disposed in a separate structure, and through a socket cooperate mounting, a mounting hinged connection 700 of the eave strut 7 is preferably in an arc structure, in addition, the mounting hinged connection 700 may also be in a straight strut structure, etc.

Figure 9:
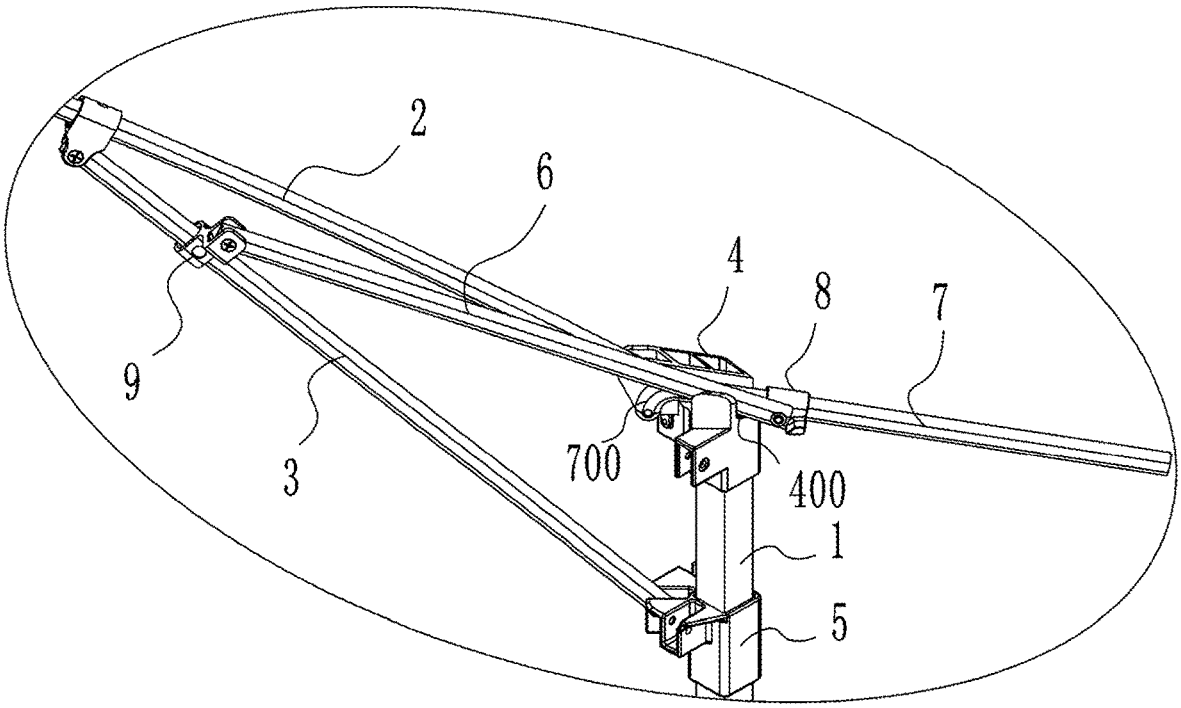
FIG. 9 is a structural view 4 of the folding canopy in a state of being used of the present invention showing the folding canopy in the fully unfolded state.

Continuing to refer to FIG. 9, when the eave strut 7 is in the eave state, the eave strut 7 and the diagonal strut 6 abut against the top seat 4. Specifically, the top seat 4 has a cooperating slot 400. When the eave strut 7 is in an eave state, the eave strut 7 and the diagonal strut 6 is jointly snapped to the cooperating slot 400.

Due to such disposition, the eave strut 7 is more solid and less likely to loosen when it is in an out-extending state.

Continuing to refer to FIG. 6-FIG. 9, a second hinged seat 8 is disposed on the eave strut 7 and the diagonal strut 6 is hingedly connected to the second hinged seat 8. Wherein, the hinged connection of the eave strut 7 with the diagonal strut 6 may also be achieved by other conventional hinged connection structures. In addition, the second hinged seat 8 is disposed with a cooperating part 800. When the folding canopy is in the folded state, the folding canopy is retracted and closed, the cooperating part 800 abuts against the diagonal strut 6, and the shape of the cooperating surface of the cooperating part 800 coincides with the shape of the diagonal strut 6. The dispose of the cooperating part 800 makes the eave strut 7 and diagonal strut 6 more stable and less likely to shake in the folded state.

In some embodiments, the second hinged seat 8 may also be disposed on the diagonal strut 6 and hingedly connected to the eave strut 7, and correspondingly, the cooperating part 800 is used to abut against the eave strut 7.

In one of the preferred embodiments, the second hinged seat 8 may also employs a hinged connection bolt, so that the diagonal strut 6 and the eave strut 7 may complete a hinged connection to realize the above-mentioned cooperation.

Figure 6:
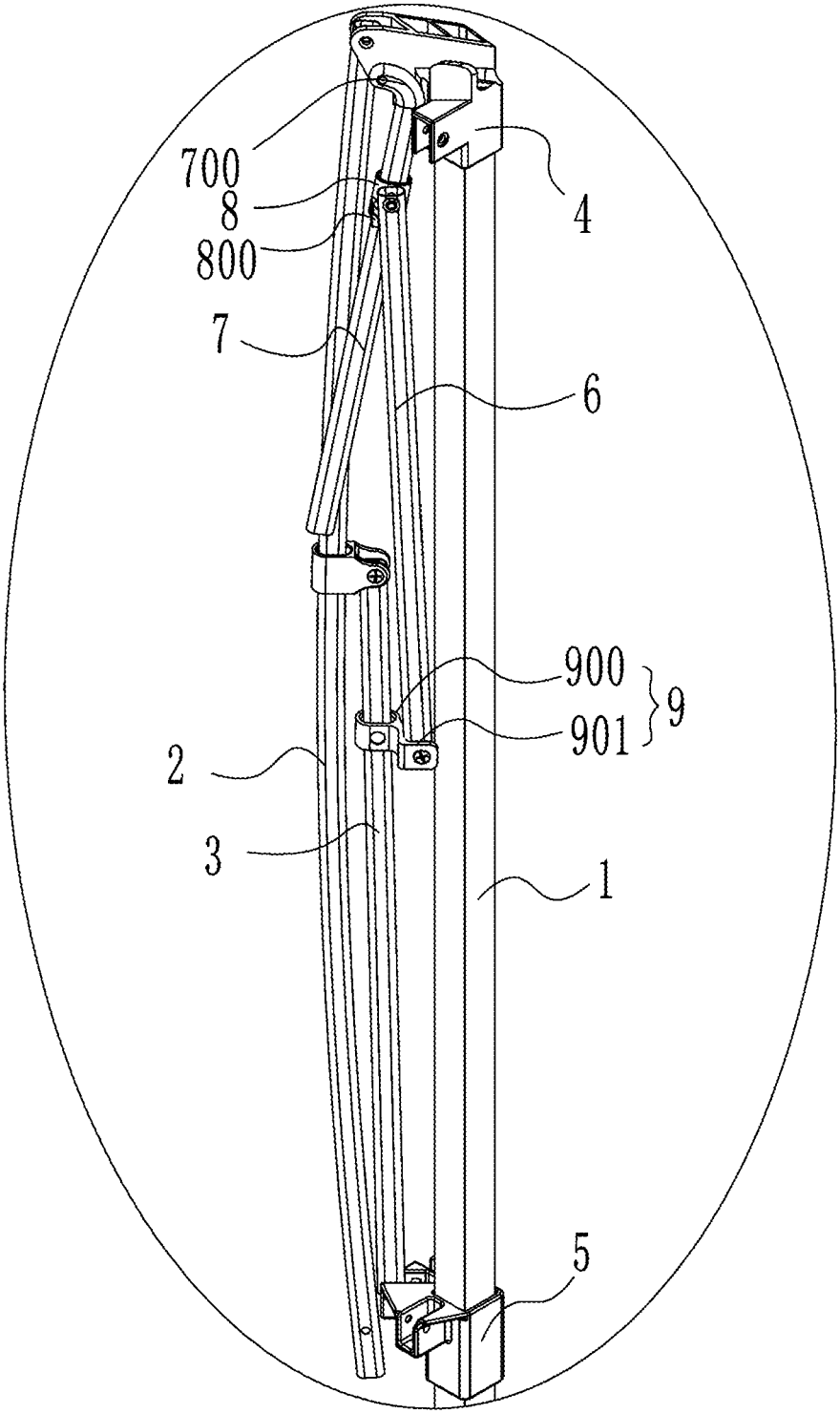
FIG. 6 is a structural view of the folding canopy in a state of being used of the present invention showing the folding canopy in the folded state.
Figure 7:
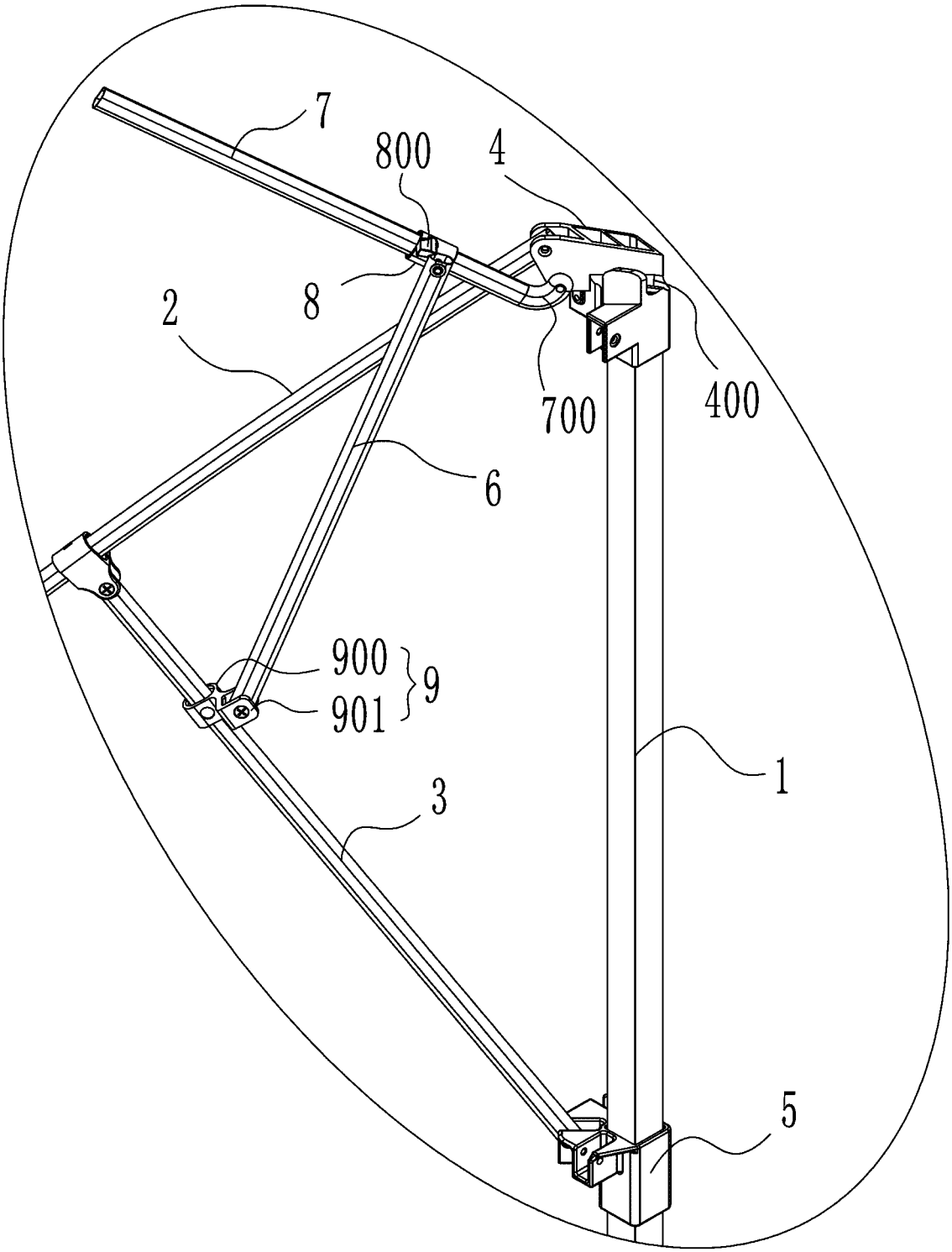
FIG. 7 is a structural view of the folding canopy in a state of being used of the present invention showing the folding canopy in the one-third unfolded state.
Figure 8:
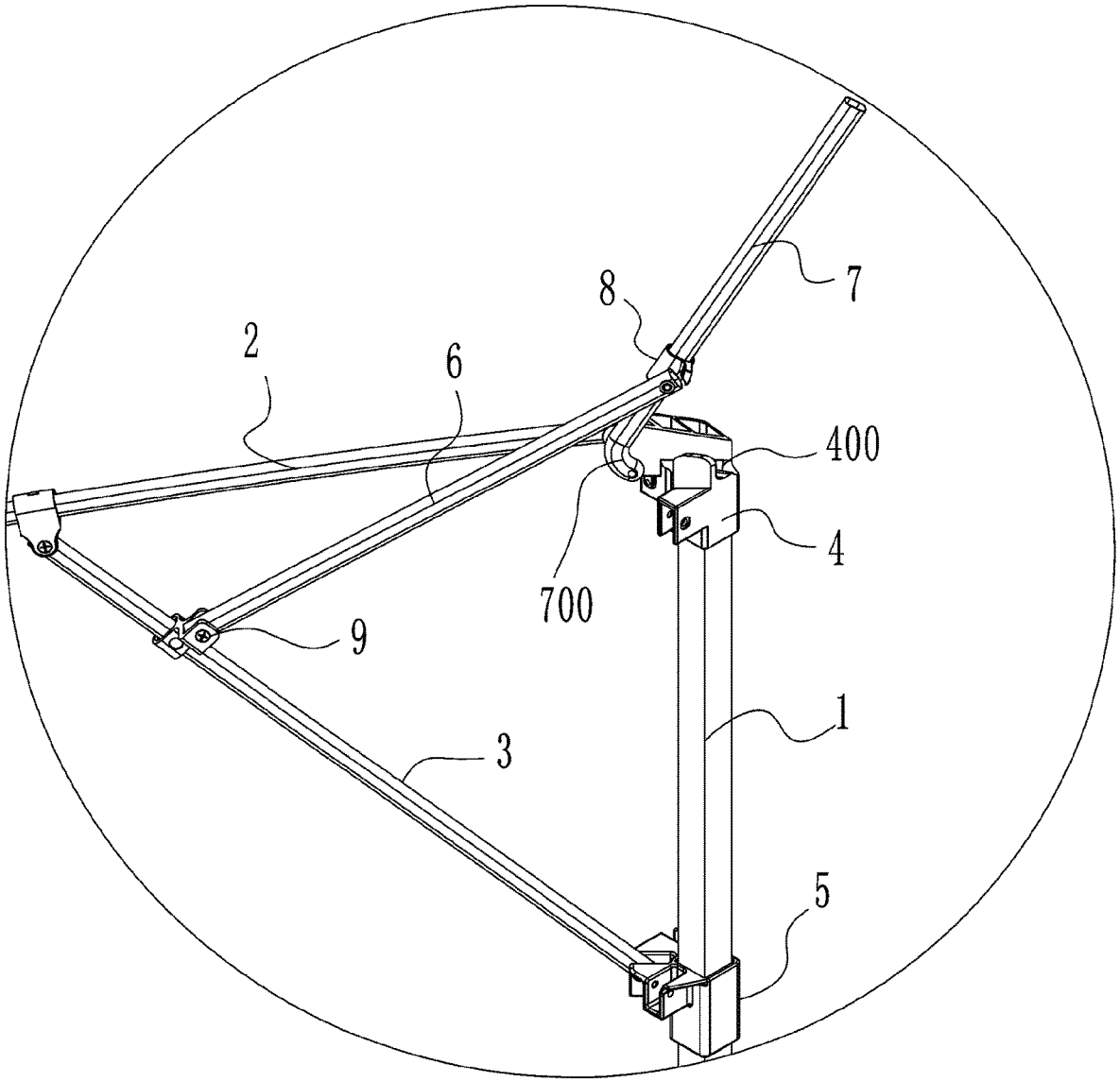
FIG. 8 is a structural view of the folding canopy in a state of being used of the present invention showing the folding canopy in the two-thirds unfolded state.

Further referring to FIG. 6, when the folding canopy is in the folded state, the folding canopy is retracted and closed, and the eave strut 7, the diagonal strut 6, the folding top strut 2 and the folding slant strut 3 are all folded into a state of being attached or being to be attached with the corresponding support leg 1.

Continuing to refer to FIG. 5-FIG. 9, a first hinged seat 9 is disposed on the folding slant strut 3, and the diagonal strut 6 is hingedly connected to the first hinged seat 9. Wherein, the hinged connection of the folding slant strut 3 with the diagonal strut 6 may also be achieved by other conventional hinged connection structures. The first hinged seat 9 includes a first hinged seat fixing part 900 used for fixedly cooperating with the folding slant strut 3 and a first hinged seat connection part 901 for hingedly connecting with the diagonal strut 6. The first hinged seat fixing part 900 and the first hinge seat connection part 901 are staggeredly disposed, so that the folding slant strut 3, the eave strut 7 and the diagonal strut 6 can be disposed in parallel.

In some embodiments, the first hinged seat 9 may also be disposed on the diagonal strut 6 and hingedly connected to the folding slant strut 3.

In one of the preferred embodiments, the first hinged seat 9 may also employs a hinged connection bolt, so that the diagonal strut 6 and the folding slant strut 3 may complete a hinged connection to realize the above-mentioned cooperation.

It should be noted that in the above-mentioned structure, the canopy folding assembly is a conventional structure in the field, which also includes a central locking mechanism 10, a folding inner upper strut 11 and a folding inner lower strut, with specific reference to FIG. 1-FIG. 5 and patent publication of CN109505454A. The side folding assembly is also a conventional structure in the field, which consists of a plurality of folding side struts 13 cross-hingedly connected, with specific reference to FIG. 1-FIG. 5 and patent publication of CN109505454A.

Figure 2:
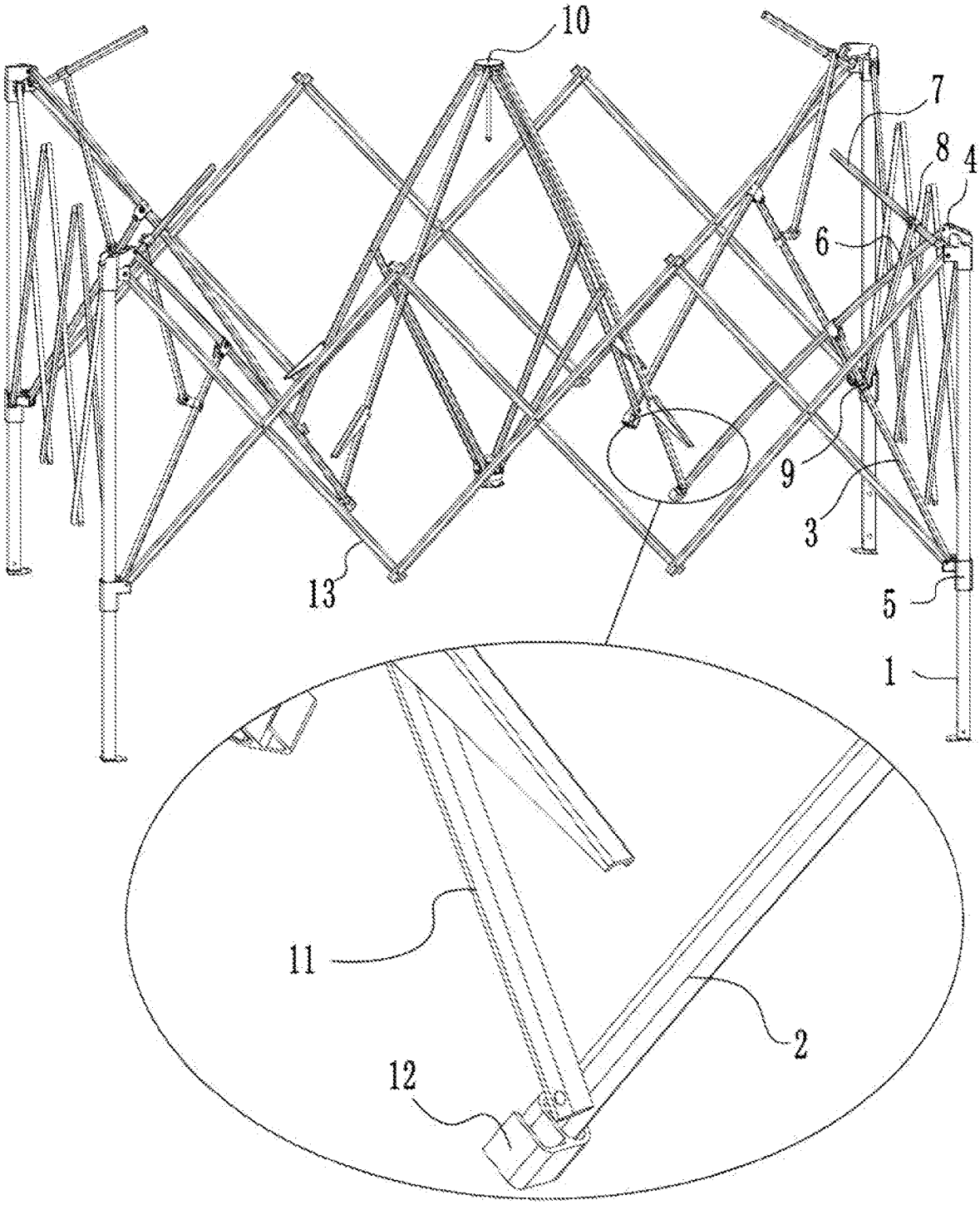
FIG. 2 is a structural view of the present invention showing the folding canopy in a one-third unfolded state.
Figure 3:
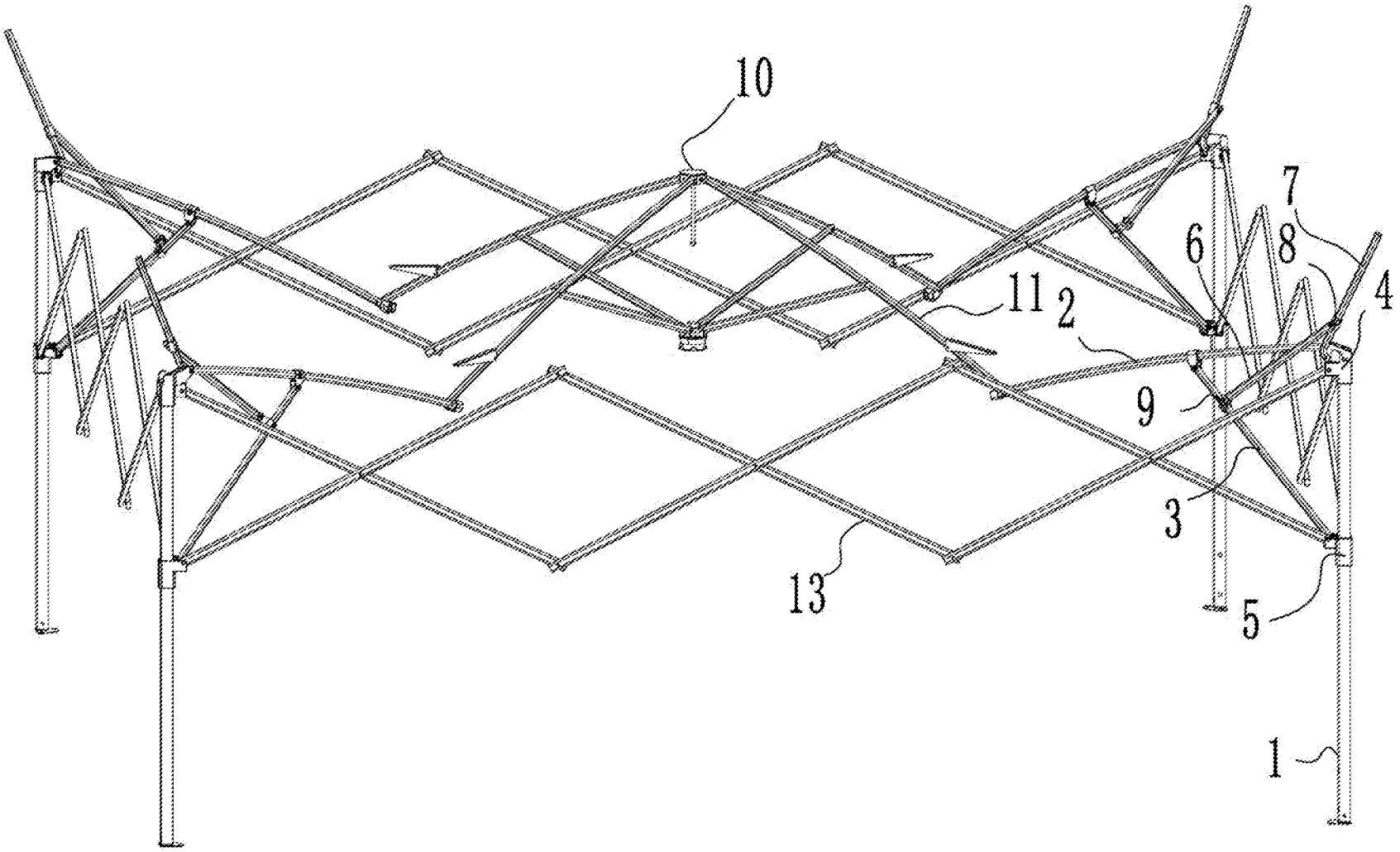
FIG. 3 is a structural view of the present invention showing the folding canopy in a two-thirds unfolded state.
Figure 4:
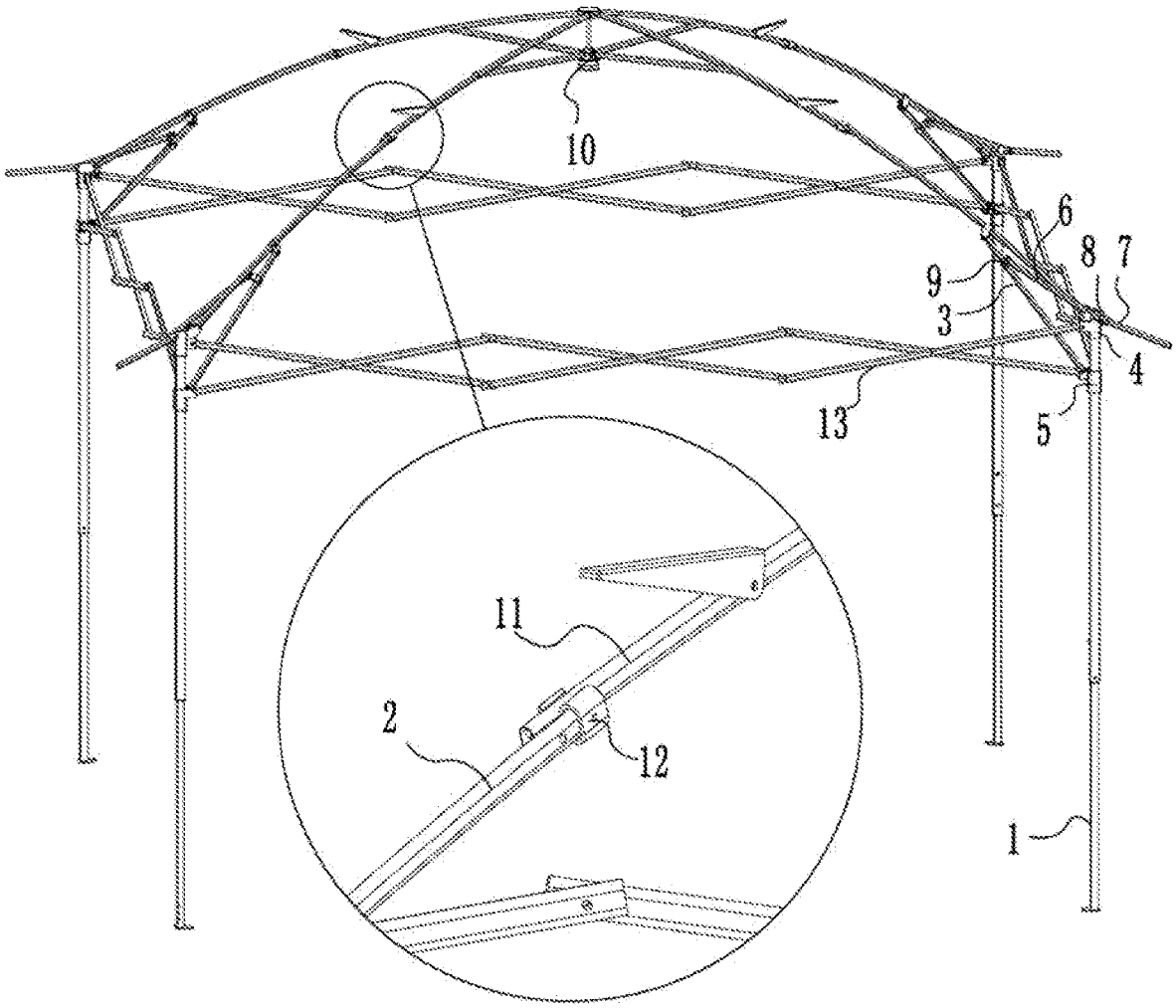
FIG. 4 is a structural view of the present invention showing the folding canopy in a fully unfolded state.
Figure 5:
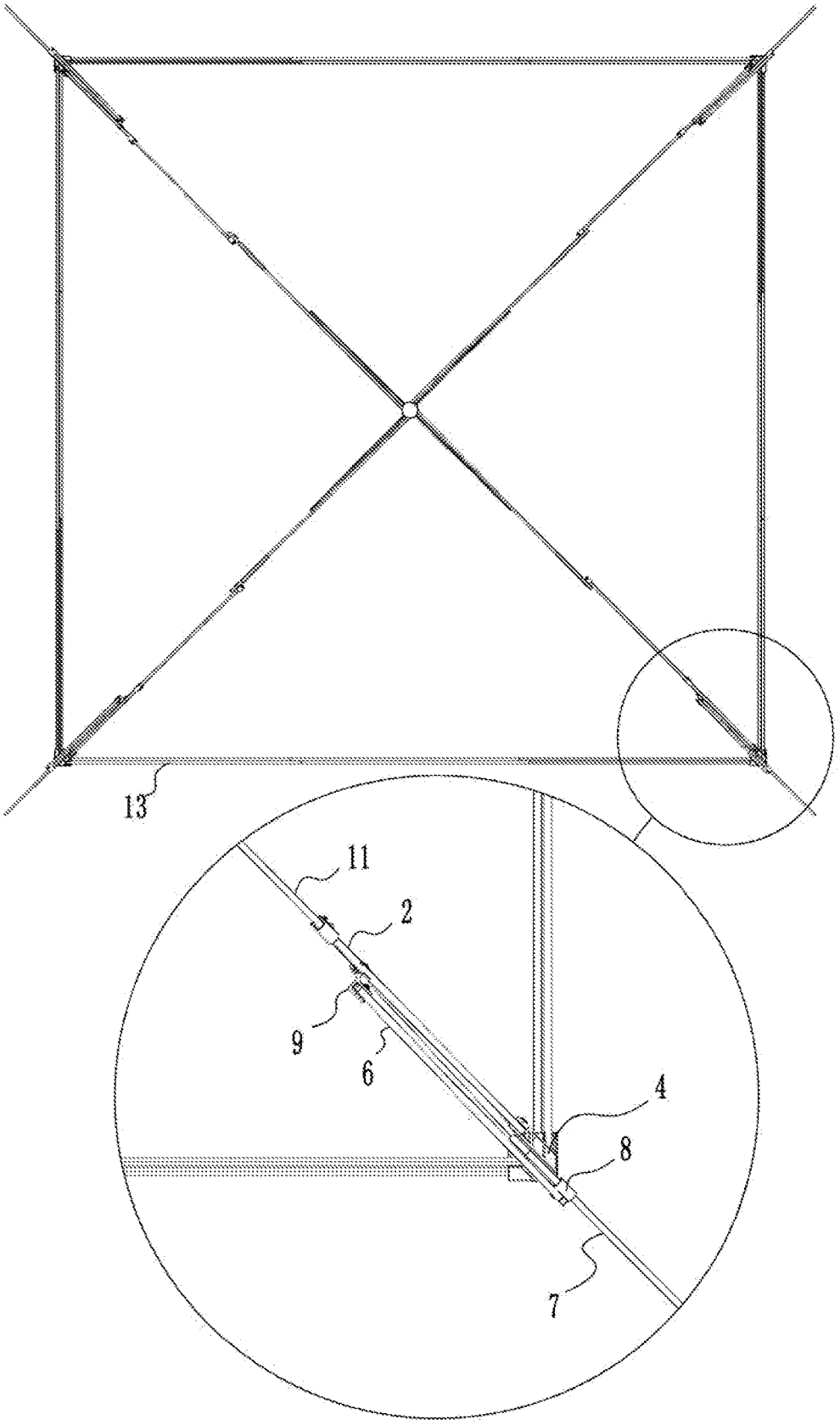
FIG. 5 is a top structural view of the present invention showing the folding canopy in the fully unfolded state.

Wherein, continuing to refer to FIG. 2 and FIG. 4, the central locking mechanism 10 is hingedly connected to the folding inner upper strut 11, the folding inner upper strut 11 is hingedly connected to the folding top strut 2, and a snap 12 is disposed at the inner end of the folding top strut 2. When the folding canopy is in a fully unfolded state, the snap 12 is snapped to the folding inner upper strut 11 to provide a more stable structure of the canopy folding assembly. In addition, the snap 12 may also be disposed on the folding inner upper strut 11 for snapping to the folding top strut 2.

The working process of the eave mechanism in the present invention is as follows. When the folding canopy is in the folded state, the state of the eave strut 7 is shown in FIG. 6. When the folding canopy needs to be unfolded, push up the sliding seat 5, the sliding seat 5 drives the folding slant strut 3 to unfold, the folding slant strut 3 drives the diagonal strut 6 to unfold, and the diagonal strut 6 then drives the eave strut 7 to flip to the state shown in FIG. 9.

Finally, it should be noted that the above embodiments are intended only to illustrate the technical solutions of the present invention, and not to limit them; despite the detailed description of the invention with reference to the preceding embodiments, it should be understood by those of ordinary skill in the art: it is still possible to modify the technical solutions recorded in the preceding embodiments, or to make equivalent substitutions for some or all of the technical features thereof; and these modifications or replacements do not make the essence of the corresponding technical solutions out of the scope of the technical solutions of the embodiments of the present invention.

What is claimed is:

1. A folding canopy with an eave structure, the folding canopy comprising a plurality of support legs and a canopy top folding assembly cooperatively mounted on the plurality of support legs, wherein in corresponding to each of the plurality of support legs, the canopy top folding assembly includes a hingedly connected folding top strut and a hingedly connected folding slant strut, a top seat and a sliding seat are disposed at the support leg, one end of the folding top strut is hingedly connected to the top seat, one end of the folding slant strut is hingedly connected to the sliding seat, and an eave mechanism is coordinately arranged between the folding slant strut and the top seat; and the eave mechanism includes a diagonal strut and an eave strut, one end of the diagonal strut is hingedly connected to the folding slant strut and the other end of the diagonal strut is hingedly connected to the eave strut, and one end of the eave strut is hingedly connected to the top seat, when the folding canopy develops from a folded state to an unfolded state, the sliding seat slides upward, the sliding seat drives the folding slant strut to move, the folding slant strut drives the diagonal strut to allow the eave strut to complete a flip and the eave strut flips outward to an eave state, and when the folding canopy is in the unfolded state, the eave strut extends out of the folding canopy, and the eave strut and/or diagonal strut abuts against the top seat.

2. The folding canopy with an eave structure according to claim 1, wherein when the folding canopy is in the folded state, the folding canopy is retracted and closed, and the eave strut, the diagonal strut, the folding top strut and the folding slant strut are all folded into a state of being attached or being to be attached with the corresponding support leg.

3. The folding canopy with an eave structure according to claim 1, wherein a first hinged seat is disposed on one of the diagonal strut and the folding slant strut, and the other one of the diagonal strut and the folding slant strut is hingedly connected to the first hinged seat.

4. The folding canopy with an eave structure according to claim 3, wherein the first hinged seat employs a hinged connection bolt, such that the diagonal strut and the folding slant strut complete a hinged connection.

5. The folding canopy with an eave structure according to claim 3, wherein the first hinged seat is disposed on the folding slant strut, and the first hinged seat includes a first hinged seat fixing part used for fixedly cooperating with the folding slant strut and a first hinged seat connection part used for being hingedly connected to the diagonal strut.

6. The folding canopy with an eave structure according to claim 1, wherein a second hinged seat is disposed on one of the diagonal strut and the eave strut and the other is hingedly connected to the second hinged seat.

7. The folding canopy with an eave structure according to claim 6, wherein the second hinged seat employs a hinged connection bolt, so that the diagonal strut and the eave strut complete a hinged connection.

8. The folding canopy with an eave structure according to claim 6, wherein a cooperating part is disposed on the second hinged seat, and when the folding canopy is in the folded state, the cooperating part abuts against the diagonal strut or the eave strut.

9. The folding canopy with an eave structure according to claim 8, wherein a shape of a coordinating surface of the cooperating part coincides with a shape of the diagonal strut or the eave strut.

10. The folding canopy with an eave structure according to claim 6, wherein the second hinged seat is disposed on the eave strut.

11. The folding canopy with an eave structure according to claim 1, wherein the eave strut has a mounting hinged connection at an inner end thereof, and the eave strut is hingedly connected to the top base through the mounting hinged connection.

12. The folding canopy with an eave structure according to claim 11, wherein the mounting hinged connection is integrally or separately disposed at the eave strut.

13. The folding canopy with an eave structure according to claim 12, wherein the mounting hinged connection employs a straight or curved strut construction.

14. The folding canopy with an eave structure according to claim 13, wherein the mounting hinged connection is provided with a hinged connection hole, and the hinged connection hole is hingedly connected to the top seat through a hinged connection bolt.

15. The folding canopy with an eave structure according to claim 14, wherein the top seat has a cooperating slot, and when the eave strut is in the eave state, the eave strut and/or the diagonal strut is snapped to the cooperating slot.

16. The folding canopy with an eave structure according to claim 1, wherein the canopy folding assembly further includes a central locking mechanism and a folding inner upper strut hingedly connected to the central locking mechanism, the folding inner upper strut is hingedly connected to the folding top strut, and one of the folding inner upper strut and the folding top strut is disposed with a snap, and when the folding canopy is in a fully unfolded state, the snap is snapped to the other one of the folding inner upper strut and the folding top strut.

17. A folding canopy with an eave structure, the folding canopy comprising a plurality of support legs and a canopy top folding assembly cooperatively mounted on the plurality of support legs, wherein in corresponding to each of the plurality of support legs, the canopy top folding assembly includes a hingedly connected folding top strut and a hingedly connected folding slant strut, a top seat and a sliding seat are disposed at the support leg, one end of the folding top strut is hingedly connected to the top seat, one end of the folding slant strut is hingedly connected to the sliding seat, and an eave mechanism is coordinately arranged between the folding slant strut and the top seat; and the eave mechanism includes a diagonal strut and an eave strut, one end of the diagonal strut is hingedly connected to the folding slant strut and the other end of the diagonal strut is hingedly connected to the eave strut, and one end of the eave strut is hingedly connected to the top seat, when the folding canopy develops from a folded state to an unfolded state, the sliding seat slides upward, the sliding seat drives the folding slant strut to move, the folding slant strut drives the diagonal strut to allow the eave strut to complete a flip and the eave strut flips outward to an eave state, and wherein the eave strut has a mounting hinged connection at an inner end thereof, and the eave strut is hingedly connected to the top base through the mounting hinged connection;

the mounting hinged connection is integrally or separately disposed at the eave strut;

the mounting hinged connection employs a straight or curved strut construction;

the mounting hinged connection is provided with a hinged connection hole, and the hinged connection hole is hingedly connected to the top seat through a hinged connection bolt; and the top seat has a cooperating slot, and when the eave strut is in the eave state, the eave strut and/or the diagonal strut is snapped to the cooperating slot.

18. A folding canopy with an eave structure, the folding canopy comprising a plurality of support legs and a canopy top folding assembly cooperatively mounted on the plurality of support legs, wherein in corresponding to each of the plurality of support legs, the canopy top folding assembly includes a hingedly connected folding top strut and a hingedly connected folding slant strut, a top seat and a sliding seat are disposed at the support leg, one end of the folding top strut is hingedly connected to the top seat, one end of the folding slant strut is hingedly connected to the sliding seat, and an eave mechanism is coordinately arranged between the folding slant strut and the top seat;

the eave mechanism includes a diagonal strut and an eave strut, one end of the diagonal strut is hingedly connected to the folding slant strut and the other end of the diagonal strut is hingedly connected to the eave strut, and one end of the eave strut is hingedly connected to the top seat, when the folding canopy develops from a folded state to an unfolded state, the sliding seat slides upward, the sliding seat drives the folding slant strut to move, the folding slant strut drives the diagonal strut to allow the eave strut to complete a flip and the eave strut flips outward to an eave state; and the canopy folding assembly further includes a central locking mechanism and a folding inner upper strut hingedly connected to the central locking mechanism, the folding inner upper strut is hingedly connected to the folding top strut, and one of the folding inner upper strut and the folding top strut is disposed with a snap, and when the folding canopy is in a fully unfolded state, the snap is snapped to the other one of the folding inner upper strut and the folding top strut.

* * * * *